US008004479B2

(12) United States Patent
White et al.

(10) Patent No.: US 8,004,479 B2
(45) Date of Patent: Aug. 23, 2011

(54) ELECTROLUMINESCENT DISPLAY WITH INTERLEAVED 3T1C COMPENSATION

(75) Inventors: Christopher J. White, Avon, NY (US); Charles I. Levey, West Henrietta, NY (US); Michael E. Miller, Honeoye Falls, NY (US); Felipe A. Leon, Rochester, NY (US)

(73) Assignee: Global OLED Technology LLC, Herndon, VA (US)

( * ) Notice: Subject to any disclaimer, the term of this patent is extended or adjusted under 35 U.S.C. 154(b) by 937 days.

(21) Appl. No.: 11/946,392

(22) Filed: Nov. 28, 2007

(65) Prior Publication Data

US 2009/0135114 A1 May 28, 2009

(51) Int. Cl.
*G09G 3/30* (2006.01)

(52) U.S. Cl. ..... 345/76; 345/77; 345/78

(58) Field of Classification Search ..... 345/76–78
See application file for complete search history.

(56) References Cited

U.S. PATENT DOCUMENTS

| | | | | |
|---|---|---|---|---|
| 6,359,398 | B1 | 3/2002 | Nakajima et al. | |
| 6,369,851 | B1 | 4/2002 | Marflak et al. | |
| 6,433,488 | B1 | 8/2002 | Bu | |
| 6,677,713 | B1 * | 1/2004 | Sung | 315/169.1 |
| 6,856,328 | B2 | 2/2005 | Holtslag | |
| 6,995,519 | B2 | 2/2006 | Arnold et al. | |
| 7,038,668 | B2 | 5/2006 | Kota et al. | |
| 7,675,493 | B2 * | 3/2010 | Yoon et al. | 345/82 |
| 7,696,773 | B2 * | 4/2010 | Levey | 324/760.01 |
| 7,859,501 | B2 * | 12/2010 | Levey et al. | 345/90 |
| 7,868,857 | B2 * | 1/2011 | Nathan et al. | 345/82 |
| 2004/0100430 | A1 | 5/2004 | Fruehauf | |

(Continued)

FOREIGN PATENT DOCUMENTS

EP 1 489 589 A1 12/2004

(Continued)

OTHER PUBLICATIONS

Shahin Jafarabadiashtiani et al.: "P-25: A New Driving Method for a-Si AMOLED Displays Based on Voltage Feedback", 2005 SID International Symposium, Boston, MA, May 24-27, 2005; [SID International Symposium], San Jose, CA: SID, US, vol. XXXVI, May 24, 2005, pp. 316-319, XP007012455, Abstract, Sections 1 & 5; Figures 6a, 6b.

International Search Report and Written Opinion of PCT/US2008/012996.

Jahinuzzaman et al, Threshold Voltage Instability of Amorphous Silicon Thin-Film Transistors Under Constant Current Stress, Appl. Phys. Lett 87, 023502 (2005).

*Primary Examiner* — Bipin Shalwala
*Assistant Examiner* — Benyam Ketema
(74) *Attorney, Agent, or Firm* — Morgan, Lewis & Bockius LLP

(57) ABSTRACT

A method of compensating for changes in the characteristics of transistors and EL devices in an EL display, includes providing an EL display having a two-dimensional array of EL devices arranged in rows and columns, wherein each EL device is driven by a drive circuit in response to a drive signal; providing a first drive circuit for an EL device having three transistors and providing a second drive circuit for an EL device having only two transistors, and wherein a first column in the display includes at least one first drive circuit and an adjacent second column includes at least one second drive circuit; deriving a correction signal based on the characteristics of a transistor in a first drive circuit, or the EL device; and using the correction signal to adjust the drive signals applied to the first drive circuit and one or more adjacent second drive circuits.

21 Claims, 6 Drawing Sheets

U.S. PATENT DOCUMENTS

2004/0201557 A1* 10/2004 Lo et al. ..... 345/82
2005/0140599 A1* 6/2005 Lee et al. ..... 345/76
2005/0180083 A1 8/2005 Takahara et al.
2005/0204313 A1* 9/2005 Enoki et al. ..... 715/867
2005/0269995 A1 12/2005 Uchino et al.
2006/0113918 A1* 6/2006 Lo et al. ..... 315/169.2
2007/0195020 A1 8/2007 Nathan et al.
2008/0122760 A1* 5/2008 Levey et al. ..... 345/78

FOREIGN PATENT DOCUMENTS

JP 2005-037843 10/2005
WO WO2005/109389 A1 11/2005
WO 2006/108277 A1 10/2006

* cited by examiner

Fig. 1: (prior art)

Fig. 2: (prior art)

ELECTROLUMINESCENT DISPLAY WITH INTERLEAVED 3T1C COMPENSATION

CROSS-REFERENCE TO RELATED APPLICATION

Reference is made to commonly-assigned co-pending U.S. patent application Ser. No. 11/766,823, filed Jun. 22, 2007, entitled "OLED Display with Aging and Efficiency Compensation" to Charles I. Levey et al., the disclosure of which is incorporated by reference herein.

FIELD OF THE INVENTION

The present invention relates to solid-state electroluminescent flat-panel display devices and more particularly to methods for driving such display devices to reduce differential aging of the EL display and provide improved display uniformity.

BACKGROUND OF THE INVENTION

Electroluminescent (EL) devices are a promising technology for flat-panel displays. For example, Organic Light Emitting Diodes (OLEDs) have been known for some years and have been recently used in commercial display devices. EL devices use thin-film layers of materials coated upon a substrate that emit light when electric current is passed through them. In OLED devices, one or more of those layers includes organic material. Using active-matrix control schemes, a plurality of EL light-emitting devices can be assembled into an EL display. EL subpixels, each including an EL device and a drive circuit, are typically arranged in two-dimensional arrays with a row and a column address for each subpixel, and are driven by a data value associated with each subpixel to emit light at a brightness corresponding to the associated data value. To make a full-color display, one or more subpixels of different colors are grouped together to form a pixel. Thus each pixel on an EL display includes one or more subpixels, e.g. red, green, and blue. The collection of all the subpixels of a particular color is commonly called a "color plane." A monochrome display can be considered to be a special case of a color display having only one color plane.

Typical large-format displays (e.g. having a diagonal of greater than 12 to 20 inches) employ hydrogenated amorphous silicon thin-film transistors (a-Si TFTs) formed on a substrate to drive the subpixels in such large-format displays. Amorphous Si backplanes are inexpensive and easy to manufacture. However, as described in "Threshold Voltage Instability Of Amorphous Silicon Thin-Film Transistors Under Constant Current Stress" by Jahinuzzaman et al. in Applied Physics Letters 87, 023502 (2005), the a-Si TFTs exhibit a metastable shift in threshold voltage ($V_{th}$) when subjected to prolonged gate bias. This shift is not significant in traditional display devices such as LCDs, because the current required to switch the liquid crystals in LCD display is relatively small. However, for LED applications, much larger currents must be switched by the a-Si TFT circuits to drive the EL materials to emit light. Thus, EL displays employing a-Si TFT circuits generally exhibit a significant $V_{th}$ shift as they are used. This $V_{th}$ shift can result in decreased dynamic range and image artifacts. Moreover, the organic materials in OLED and hybrid EL devices also deteriorate in relation to the integrated current density passed through them over time, so that their efficiency drops while their resistance to current, and thus forward voltage, increases. These effects are described in the art as "aging" effects.

These two factors, TFT and EL aging, reduce the lifetime of the display. Different organic materials on a display can age at different rates, causing differential color aging and a display whose white point varies as the display is used. If some EL devices in the display are used more than others, spatially differentiated aging can result, causing portions of the display to be dimmer than other portions when driven with a similar signal. This can result in visible burn-in. For example, this occurs when the screen displays a single graphic element in one location for a long period time. Such graphic elements can include stripes or rectangles with background information, e.g. news headlines, sports scores, and network logos. Differences in signal format are also problematic. For example, displaying a widescreen (16:9 aspect ratio) image letterboxed on a conventional screen (4:3 aspect ratio) requires the display to matte the image, causing the 16:9 image to appear on a middle horizontal region of the display screen and black (non-illuminated) bars to appear on the respective top and bottom horizontal regions of the 4:3 display screen. This produces sharp transitions between the 16:9 image area and the non-illuminated (matte) areas. These transitions can burn in over time and become visible as horizontal edges. Furthermore, the matte areas are not aged as quickly as the image area in these cases, which can result in the matte areas' being objectionably brighter than the 16:9 image area when a 4:3 (full-screen) image is displayed.

One approach to avoiding the problem of voltage threshold shift in TFT circuits is to employ circuit designs whose performance is relatively constant in the presence of such voltage shifts. For example, U.S. Patent Application Publication No. 2005/0269959 filed by Uchino et al, Dec. 8, 2005, entitled "Pixel Circuit, Active Matrix Apparatus And Display Apparatus" describes a subpixel circuit having a function of compensating for characteristic variation of an electro-optical element and threshold voltage variation of a transistor. The subpixel circuit includes an electro-optical element, a holding capacitor, and five-channel thin-film transistors. Alternative circuit designs employ current-mirror driving circuits that reduce susceptibility to transistor performance. For example, U.S. Patent Application Publication No. 2005/0180083 filed by Takahara et al., Aug. 15, 2005 entitled "Drive Circuit For EL Display Panel" describes such a circuit. However, such circuits are typically much larger and more complex than the two-transistor, single capacitor (2T1C) circuits otherwise employed, thereby reducing the aperture ratio (AR), the percent of the area on a display available for emitting light. The decrease in AR decreases the display lifetime by increasing the current density through each EL device.

Other methods used with a-Si TFTs rely upon measuring the threshold-voltage shift. For example, U.S. Patent Application Publication No. 2004/0100430A1 "Active Matrix Drive Circuit" by Fruehauf, published May 27, 2004, describes an OLED subpixel circuit including a conventional 2T1C subpixel circuit and a third transistor used to carry a current to an off-panel current measurement circuit. As Vth shifts and the OLED ages, the current decreases. This decrease in current is measured and used to adjust the data value used to drive the subpixel. Similarly, U.S. Pat. No. 6,433,488 B1 "OLED Active Driving System with Current Feedback" by Bu, granted Aug. 13, 2002, describes using a third transistor to measure the current flowing through an OLED device under a test condition and comparing that current to a reference current to adjust the data value. Additionally, Arnold et al., in commonly-assigned U.S. Pat. No. 6,995,519, granted Feb. 7, 2006, teach using a third transistor to produce a feedback signal representing the voltage across the OLED, allowing for compensation of OLED aging but not Vth shift. However, although these schemes do not require as many transistors as subpixel circuits with internal compensation, they do require additional signal lines on a display backplane to carry the measurements. These additional signal lines reduce aperture ratio and add assembly cost. For example, these schemes can require one additional data line per column. This doubles the number of lines that have to be bonded to driver integrated circuits, increasing the cost of an assembled display, and increasing the probability of bond failure, thus decreasing the yield of good displays from the assembly line. This problem is particularly acute for large-format, high-resolution displays, which can have over two thousand columns. However, it also affects smaller displays, as higher bondout counts can require higher-density connections, which are more expensive to manufacture and have lower yield than lower-density connections.

Alternative schemes for reducing image burn-in have been addressed for televisions using a cathode ray tube display. U.S. Pat. No. 6,359,398 entitled "Method to Control CRT Phosphor Aging" issued Mar. 19, 2002, describes methods and apparatus that are provided for equally aging a cathode ray tube (CRT). Under this scheme, when displaying an image of one aspect ration on a display of a different aspect ratio, the matte areas of the display are driven with an equalization video signal. In this manner, the CRT is uniformly aged. However, the solution proposed requires the use of a blocking structure such as doors or covers that can be manually or automatically provided to shield the matte areas from view when the equalization video signal is applied to the otherwise non-illuminated region of the display. This solution is unlikely to be acceptable to most viewers because of the cost and inconvenience. U.S. Pat. No. 6,359,398 also discloses that matte areas can be illuminated with gray video having luminance intensity matched to an estimate of the average luminous intensity of the program video displayed in the primary region. As indicated therein, however, such estimation is not perfect, resulting in a reduced, but still present, non-uniform aging.

U.S. Pat. No. 6,369,851 entitled "Method and Apparatus to Minimize Burn Lines in a Display" issued Apr. 9, 2002 describes a method and apparatus for displaying a video signal using an edge modification signal to reduce spatial frequency and minimize edge burn lines, or a border modification signal to increase brightness of image content in a border area of a displayed image, where the border area corresponds to a non-image area when displaying images with a different aspect ratio. However, these solutions can cause objectionable image artifacts, for example reduced sharpness or visibly brighter border areas in displayed images.

The general problem of regional brightness differences due to burn-in of specific areas due to video content has been addressed in the prior art, for example by U.S. Pat. No. 6,856,328 entitled, "System and method of displaying images." This disclosure teaches that the burn-in of graphic elements as described above can be prevented by detecting those elements in the corners of the image and reducing their intensity to the average display load. This method requires the detection of static areas and may not prevent color-differentiated burn-in. An alternative technique is described in Japanese Publication No. 2005-037843 A by Igarashi et al. entitled "Camera and Display Control Device". In this disclosure, a digital camera is provided with an organic EL display that is prevented from burning in by employing a DSP in the digital camera. The DSP changes the position of an icon on the organic EL display by changing the position of the icon image data in a memory every time that the camera is turned on. Since the degree to which the display position is changed is approximately one pixel a user cannot recognize the change in the display position. However, this approach requires a prior knowledge and control of the image signal and does not address the problem of format differences.

U.S. Patent Application Publication No. 2005/0204313 A1 by Enoki et al. describes a further method for display screen burn prevention, wherein an image is gradually moved in an oblique direction in a specified display mode. This and similar techniques are generally called "pixel orbiter" techniques. Enoki et al. teach moving the image as long as it displays a still image, or at predetermined intervals. Kota et al., in U.S. Pat. No. 7,038,668, granted May 2, 2006, teach displaying the image in a different position for each of a predetermined number of frames. Similarly, commercial plasma television products advertise pixel orbiter operational modes that sequentially shift the image three pixels in four directions according to a user-adjustable timer. However, these techniques may not employ all pixels of a display, and therefore may create a border effect of pixels that are brighter than those pixels in the image area that are always used to display image data.

Existing methods for mitigating image burn-in on EL displays generally either require additional display circuitry or manipulate the displayed image. Methods requiring additional display circuitry can reduce the lifetime of the display, increase its cost, and reduce manufacturing yield. Methods manipulating the displayed image cannot correct for all burn-in. Accordingly, there is a need for an improved method and apparatus for providing improved display uniformity in electroluminescent flat-panel display devices.

SUMMARY OF THE INVENTION

According to the present invention, there is provided a method of compensating for changes in the characteristics of transistors and EL devices in an EL display, comprising:

(a) providing an EL display having a two-dimensional array of EL devices arranged in rows and columns, wherein each EL device is driven by a drive circuit in response to a drive signal;

(b) providing a first drive circuit for an EL device having three transistors and providing a second drive circuit for an EL device having only two transistors, and wherein a first column in the display includes at least one first drive circuit and an adjacent second column includes at least one second drive circuit;

(c) deriving a correction signal based on the characteristics of at least one of the transistors in a first drive circuit, or the EL device, or both; and (d) using the correction signal to adjust the drive signals applied to the first drive circuit and one or more adjacent second drive circuits.

It is an advantage of the present invention that it can compensate for changes in the electrical characteristics of the thin-film transistors or the EL device of an EL display subpixel. It is a further advantage of this invention that it can so compensate without increasing the complexity of the within-subpixel circuits. It is a further advantage of the present invention that it can improve yield and reduce cost of EL displays. It is a further advantage of the present invention that it applies pixel orbiter technology in EL displays, and in combination with three-transistor, one-capacitor (3T1C) pixel circuits. It is a further advantage of the present invention that it changes the location of the image as frequently as possible, and at times when the image content hides movements.

BRIEF DESCRIPTION OF THE DRAWINGS

Identical reference numbers have been used, where possible, to designate identical features that are common to the following figures.

DETAILED DESCRIPTION OF THE INVENTION

Figure 1:
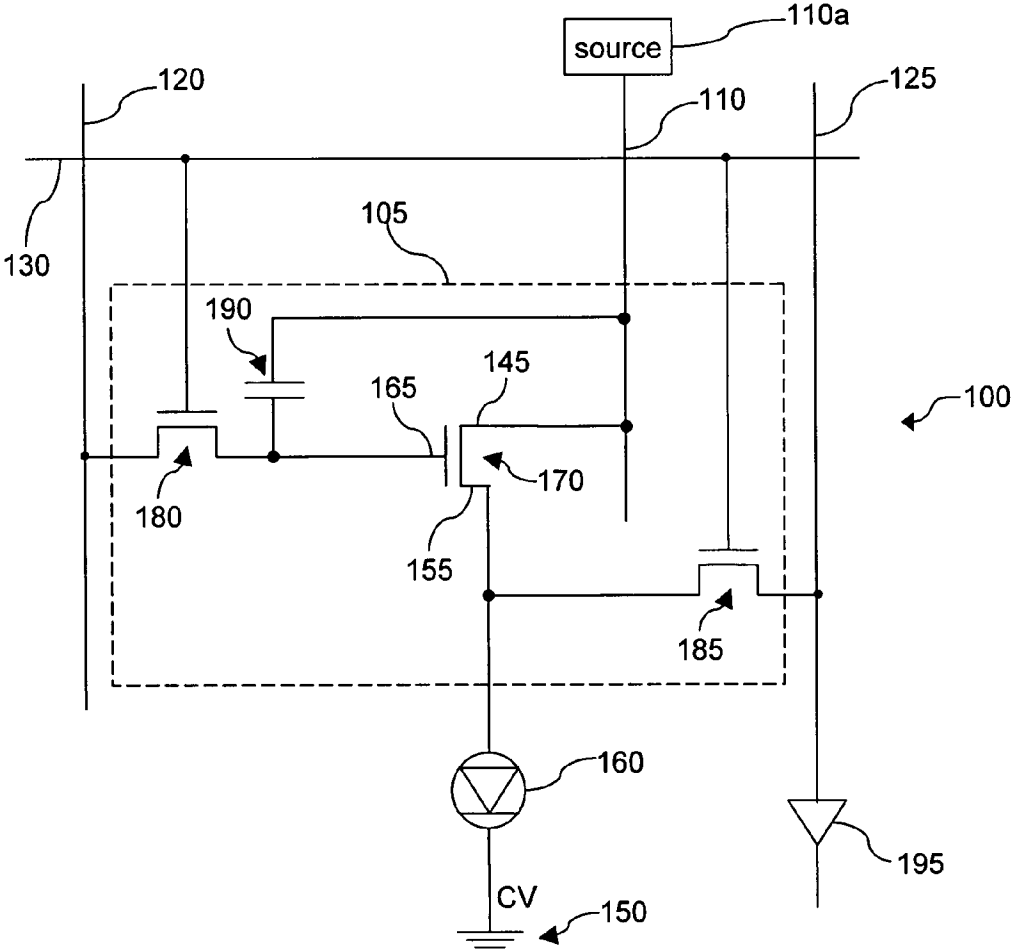
FIG. 1 shows a schematic diagram of an EL display subpixel according to the prior art.

Turning now to FIG. 1, there is shown a schematic diagram of an EL subpixel according to the prior art. Such subpixels are well known in the art in active matrix EL displays. EL subpixel 100 includes a light-emitting EL device 160 and a drive circuit 105. EL subpixel 100 is connected to a data line 120, a first power supply line 110 driven by a first voltage source 110*a*, a select line 130, and a second voltage source 150. Drive circuit 105 includes a drive transistor 170, a switch transistor 180, and a capacitor 190. Drive transistor 170 can be an amorphous-silicon (a-Si) transistor. It has first electrode 145, a second electrode 155, and a gate electrode 165. First electrode 145 of drive transistor 170 is connected to first power supply line 110, while second electrode 155 is connected to EL device 160. In this embodiment of drive circuit 105, first electrode 145 of drive transistor 170 is a drain electrode and second electrode 155 is a source electrode, and drive transistor 170 is an n-channel device. In this embodiment EL device 160 is a non-inverted EL device that is connected to drive transistor 170 and to second voltage source 150. In this embodiment, the second voltage source 150 is ground. Those skilled in the art will recognize that other embodiments can use other sources as the second voltage source. Switch transistor 180 has a gate electrode connected to select line 130, as well as source and drain electrodes, one of which is connected to the gate electrode 165 of drive transistor 170, and the other of which is connected to data line 120.

EL device 160 is powered by flow of current between power supply line 110 and second voltage source 150. In this embodiment, the first voltage source 110*a* has a positive potential relative to the second voltage source 150, to cause current to flow through drive transistor 170 and EL device 160, so that EL device 160 produces light. The magnitude of the current—and therefore the intensity of the emitted light—is controlled by drive transistor 170, and more specifically by the magnitude of the signal voltage on gate electrode 165 of drive transistor 170. During a write cycle, select line 130 activates switch transistor 180 for writing and the signal voltage data on data line 120 is written to drive transistor 170 and stored on capacitor 190 that is connected between gate electrode 165 and first power supply line 110.

As discussed above, a-Si transistors such as drive transistor 170, and EL devices such as 160, have aging effects. It is desirable to compensate for such aging effects to maintain consistent brightness and color balance of the display, and to prevent image burn-in. For readout of values useful for such compensation, drive circuit 105 further includes a readout transistor 185, connected to the second electrode 155 of the drive transistor 170 and to readout line 125. The gate electrode of the readout transistor 185 can be connected to the select line 130, or in general to some other readout-selection line. The readout transistor 185, when active, electrically connects second electrode 155 to readout line 125 that carries a signal off the display to electronics 195. Electronics 195 can include, for example, a gain buffer and an A/D converter to read the voltage at electrode 155.

Figure 2:
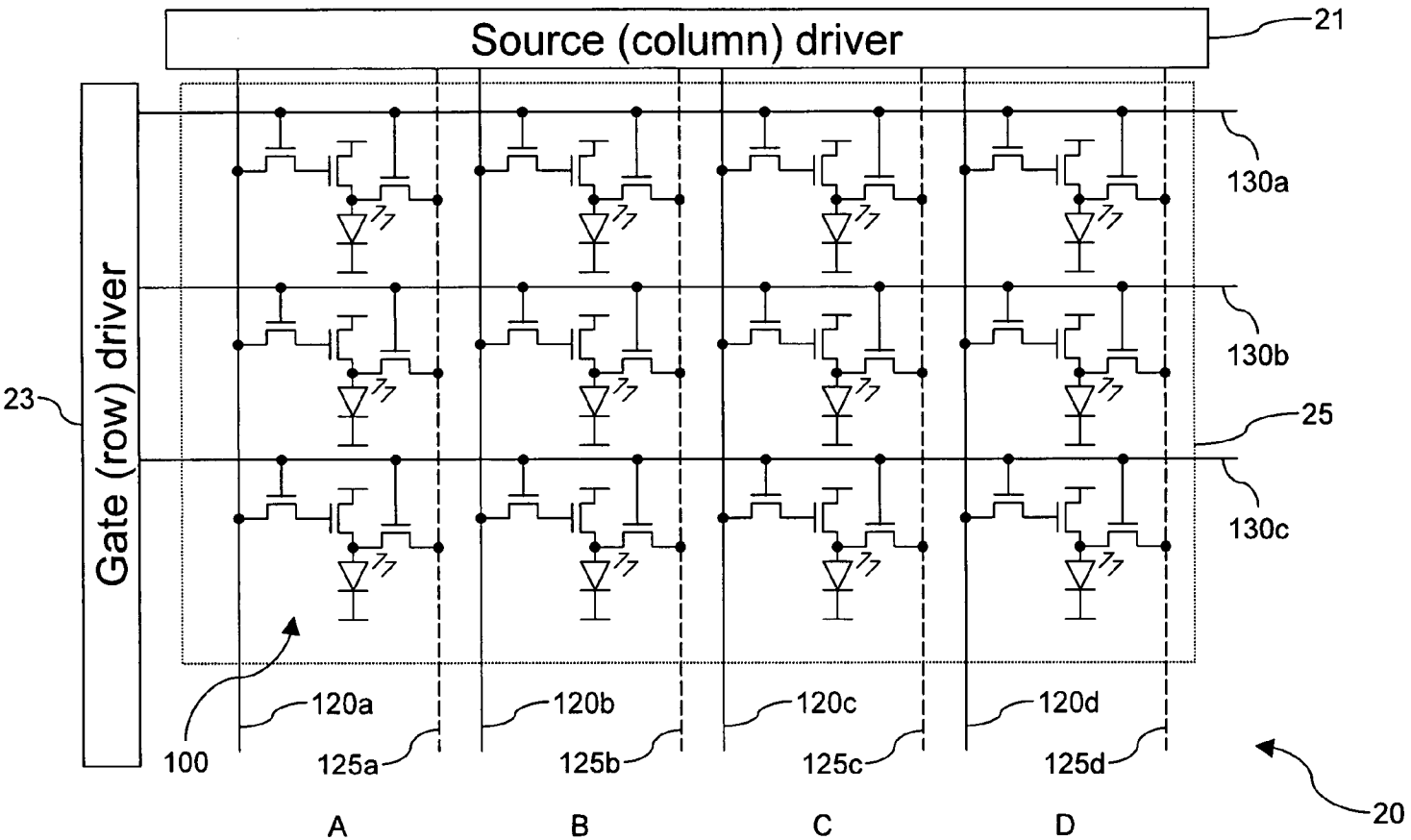
FIG. 2 shows a schematic diagram of an EL display according to the prior art.

Turning now to FIG. 2, there is shown an EL display 20 according to the prior art. The display 20 includes a source driver 21, a gate driver 23, and a display matrix. 25. The display matrix 25 has a plurality of EL subpixels 100 arranged in rows and columns. Each row has a select line (130*a*, 130*b*, 130*c*). Each column has a data line (120*a*, 120*b*, 120*c*, 120*d*) and a readout line (125*a*, 125*b*, 125*c*, 125*d*). Each subpixel includes a drive circuit and an EL device, as shown in FIG. 1. Current is driven through each EL device by a drive transistor in its corresponding drive circuit in response to a drive signal carried on its column's data line 120 and applied to the gate electrode 165 of the drive transistor 170. As EL devices are generally current-driven, driving current through an EL device with a drive circuit is conventionally referred to as driving the EL device. The column of subpixel circuits connected to data line 120*a* will hereinafter be referred to as "column A," and likewise for columns B, C, and D, as indicated on the figure. The readout lines 125 are shown dashed on FIG. 2 for clarity only; they are electrically continuous along the whole column. The data lines 120 and the readout lines 125 are both connected to source driver 21, doubling the bond count required over a simple two-transistor, one-capacitor (2T1C) design. The readout lines can also be connected to a readout circuit not included in the source driver. The terms "row" and "column" do not imply any particular orientation of the EL display. Rows and columns can be interchanged without loss of generality. The readout lines can be oriented in other configurations than parallel to the column lines.

Figure 3:
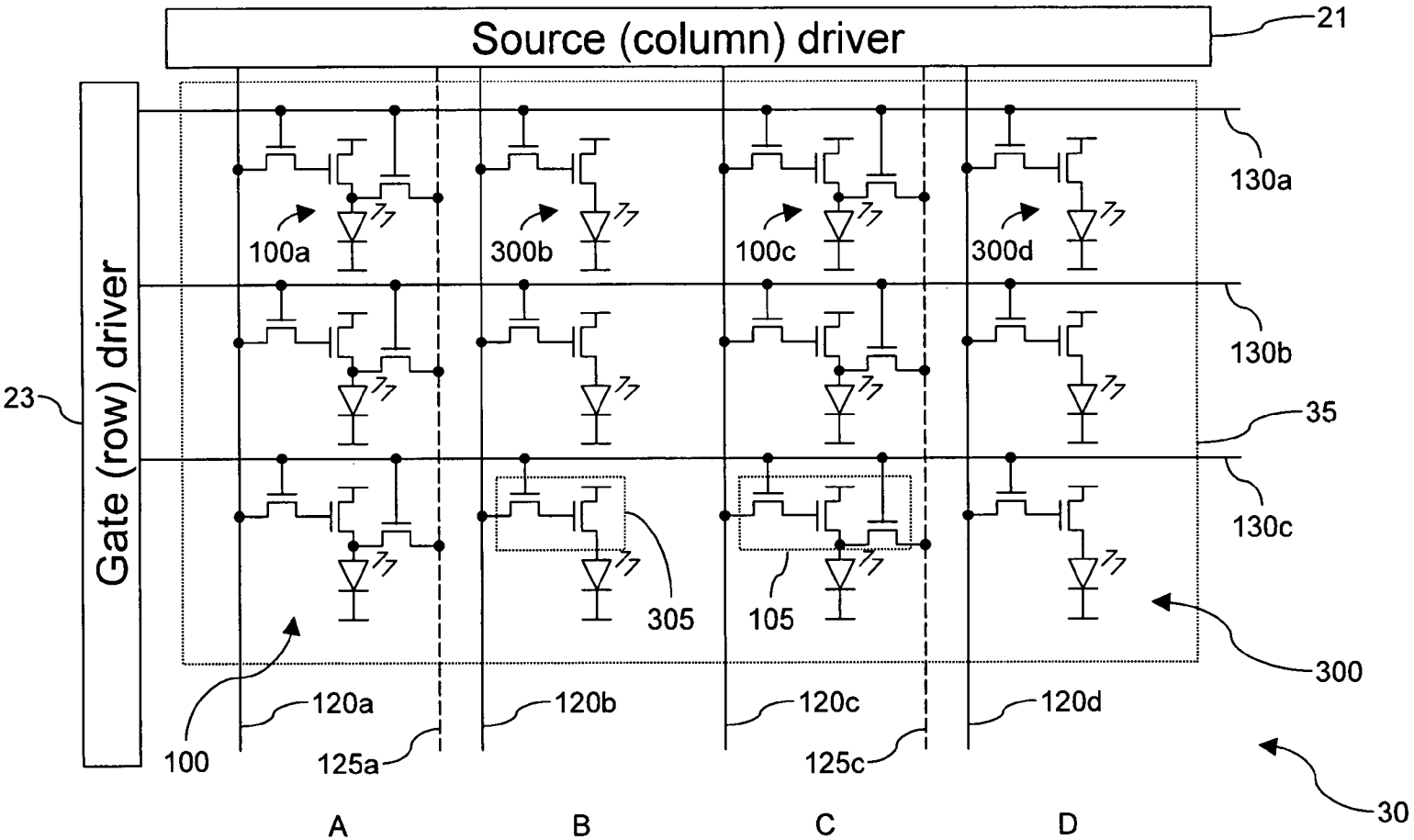
FIG. 3 shows a schematic diagram of an EL display according to a first embodiment of this invention.

Turning now to FIG. 3, there is shown an EL display according to a first embodiment of the present invention, used in a method of compensating for changes in transistors and EL devices in an EL display. EL display 30 includes a source driver 21 and gate driver 23 as in FIG. 2, and a display matrix 35: a two-dimensional array of subpixels arranged in rows and columns. The display matrix 35 has subpixels with two types of drive circuits for EL devices: a first drive circuit 105 having three transistors, in first subpixels e.g. 100, and a second drive circuit 305 having only two transistors, in second subpixels e.g. 300. The first drive circuits 105 can be three-transistor, one-capacitor (3T1C) drive circuits as known in the art, and as shown in FIG. 1. The second drive circuits 305 can be 2T1C subpixel circuits as known in the art; these can be identical to the subpixel circuits of FIG. 1, but omitting readout transistor 185 and readout line 125. Each EL device is driven in response to a drive signal as discussed above. The characteristics of the transistors and EL devices in the EL display can change over time. For example, the EL display can be an OLED display. Each EL device can be an OLED device, and each transistor can be an amorphous silicon (a-Si) transistor. In this case, as discussed above, the efficiency of an OLED device and the threshold voltage of an a-Si transistor can change over time.

The display matrix 35 includes columns of two types: a first column in the display, e.g. column A, which includes at least one first drive circuit, and an adjacent second column, e.g. column B, including only second drive circuits. In FIG. 3, columns A and C are first columns, and columns B and D are second columns. First columns have data lines 120*a*, 120*c* and readout lines 125*a*, 125*c*. Second columns have data lines 120*b*, 120*d*, but do not have readout lines, so 125*b* and 125*d* of FIG. 2 are not present on FIG. 3. This removes half of the readout lines, reducing cost and improving yield over prior-art methods. Additionally, the area saved by not having the third transistor or readout line in the second columns can be distributed over the first and second columns in order to increase the aperture ratio (AR) of all subpixels. The aperture ratio of an EL device is the percent of the area of its corresponding EL subpixel that is occupied by the light-emitting area of the EL device. For example, if a subpixel with a first drive circuit has an AR of 40%, and an adjacent subpixel with a second drive circuit has an AR of 50%, the extra 10% aperture on the second drive circuit subpixel can be distributed across both subpixels to provide approximately a 45% AR for both. It is desirable to provide EL devices driven by first drive circuits with the same AR as EL devices driven by second drive circuits, as unequal ARs can cause the higher-AR subpixels to appear visibly brighter than the lower-AR subpixels. This is because a higher-AR subpixel emits more light for a given current than a lower-AR subpixel. Alternatively, the AR can be designed to have a desired differential between neighboring subpixels, and the difference in brightness due to the difference in AR can be reduced by adjusting the current or placing optical filters between the subpixel and the viewer.

In a second embodiment of the present invention, a second column can include at least one first drive circuit and at least one second drive circuit. For example, subpixels in even rows of a first column can have first drive circuits, and subpixels in odd rows of an adjacent second column can have second drive circuits. In this case, one readout line would be connected to the first drive circuits of both columns, thus providing the advantage of reduced readout-line count. An example of this method will be discussed in the fifth embodiment, below. In general, a second column can include at least one second drive circuit.

In order to correct for aging, a correction signal can be derived based on the characteristics of at least one of the transistors in a first drive circuit, or the EL device, or both. This correction signal can be used to correct for burn-in by adjusting the drive signals applied to the first drive circuit and one or more adjacent second drive circuits. For example, the correction signal from subpixel 100*a*, containing a first drive circuit, can be used to adjust the drive signals applied to both subpixel 100*a* and an adjacent subpixel 300*b*. Alternatively, the correction signals from subpixels 100*a* and 100*c* can be averaged to correct adjacent subpixel 300*b*. Other methods for applying signals from subpixels to adjacent subpixels will be obvious to those skilled in the art. This permits compensating for changes in the characteristics of transistors and EL devices.

The correction signal can be derived in a variety of ways, for example that of above-cited commonly-assigned application U.S. Ser. No. 11/766,823. The present invention does not restrict how the compensation signal can be derived, or how it can be used to adjust the drive signals of subpixels. The compensation signal can be used to compensate for changes in the characteristics of transistors or EL devices.

FIG. 3 shows first columns A and C as including entirely first subpixel circuits. However, other configurations will be evident to those skilled in the art. For example, a first column can include alternating first subpixel circuits and second subpixel circuits, or there can be two second columns in between each pair of first columns. Such configurations slightly reduce the accuracy of the compensation of second subpixel circuits while increasing the aperture ratio of all subpixels. Alternatively, there can be two first columns in between each pair of second columns. This will slightly increase the accuracy of the compensation of second subpixel circuits while decreasing the aperture ratio of all subpixels. First drive circuits can advantageously occur with high spatial frequency across the display to take advantage of the human eye's reduced sensitivity to high-frequency noise compared to low-frequency noise. Specifically, for any given display type, first columns can advantageously be arranged on the display with higher spatial frequency than a selected reference spatial frequency, which can be the spatial frequency of typical image content for that display type.

Some images create burn-in patterns with sharp edges when displayed for long periods of time. For example, letterboxing, as described above, creates two sharp horizontal edges between the 16:9 image area and the matte areas. As a result, it is desirable for the correction signals to have a sharp transition at these boundaries to provide an appropriate compensation. It can therefore be advantageous to apply edge detection algorithms as known in the art to the correction signals of a plurality of the subpixels of one or more color planes of the display to determine the location of these sharp transition boundaries for subpixels for which the compensation is not measured but inferred from neighboring subpixels. These algorithms can be employed to determine the presence of sharp transitions. A sharp transition of the correction signals is a significant difference in values of the correction signals between adjacent subpixels or subpixels within a defined distance of each other. A significant change can be a difference between correction signal values of at least 20%, or a difference of at least 20% of the average of a group of neighboring values. Sharp transitions can follow lines, e.g. along horizontal, vertical or diagonal dimensions. In such a linear sharp transition, any subpixel will have a significant difference in correction signal value compared to an adjacent subpixel on the opposite side of the sharp transition. For example, a sharp transition between two adjacent columns is characterized by a significant difference between each subpixel in one column and the subpixel in the same row of the other column.

The location of a sharp transition with respect to the subpixel containing the second drive circuit 305 can be determined using correction signals from neighboring subpixels in the same color plane or subpixels in a different color plane having a correlated signal. If such a transition is found to occur, for any given second subpixel, correction signals from first subpixels on the same side of the transition as the second subpixel can be given higher weight than correction signals from first subpixels on the opposite side of the transition as the second subpixel. This can improve image quality in displays with sharp-edged burn-in patterns with no extra hardware cost. Specifically, this method can be applied by locating one or more sharp transitions in the correction signals over the two-dimensional EL subpixel array using edge-detection algorithms as known in the art; and, for each sharp transition, using the correction signal for a first drive circuit to adjust the drive signals applied to the first drive circuit and one or more adjacent second drive circuits on the same side of the sharp transition.

It can be desirable to combine this analysis of burn-in edges, represented by sharp transitions in the correction signals, with an analysis of image content to determine how to apply correction signals to second subpixels. For example, pillarboxing, in which a 4:3 image is displayed on a 16:9 display, can create vertical burn-in edges analogous to the horizontal burn-in edges created by letterboxing. On a display configured as FIG. 3, if column B were the rightmost column of a pillarbox matte area, the correction signals from columns A and C would show a sharp transition between them. However, those correction signals would be insufficient to determine whether the edge fell between columns A and B or between columns B and C. In this case, analysis of image content when displaying a pillarboxed image would indicate that the edge fell between columns B and C, and thus that the correction signals from column A would advantageously be assigned higher weight than the correction signals from column C when compensating column B. Specifically, this method can be employed by displaying an image on the EL display, locating one or more sharp image transitions in the displayed image data using edge-detection algorithms known in the art, and employing the locations of the sharp transitions discussed above and the sharp image transitions to selectively apply correction signals from first drive circuits to adjust the drive signals applied to the first drive circuits and one or more adjacent second drive circuits. Sharp transitions in the image data are defined similarly to sharp transitions in the correction signals: significant differences in image data between adjacent subpixels. Sharp transitions can also be significant differences between the luminances of adjacent pixels, calculated for example using the formulas of the sRGB standard (IEC 61966-2-1:1999, section 5.2).

Figure 4:
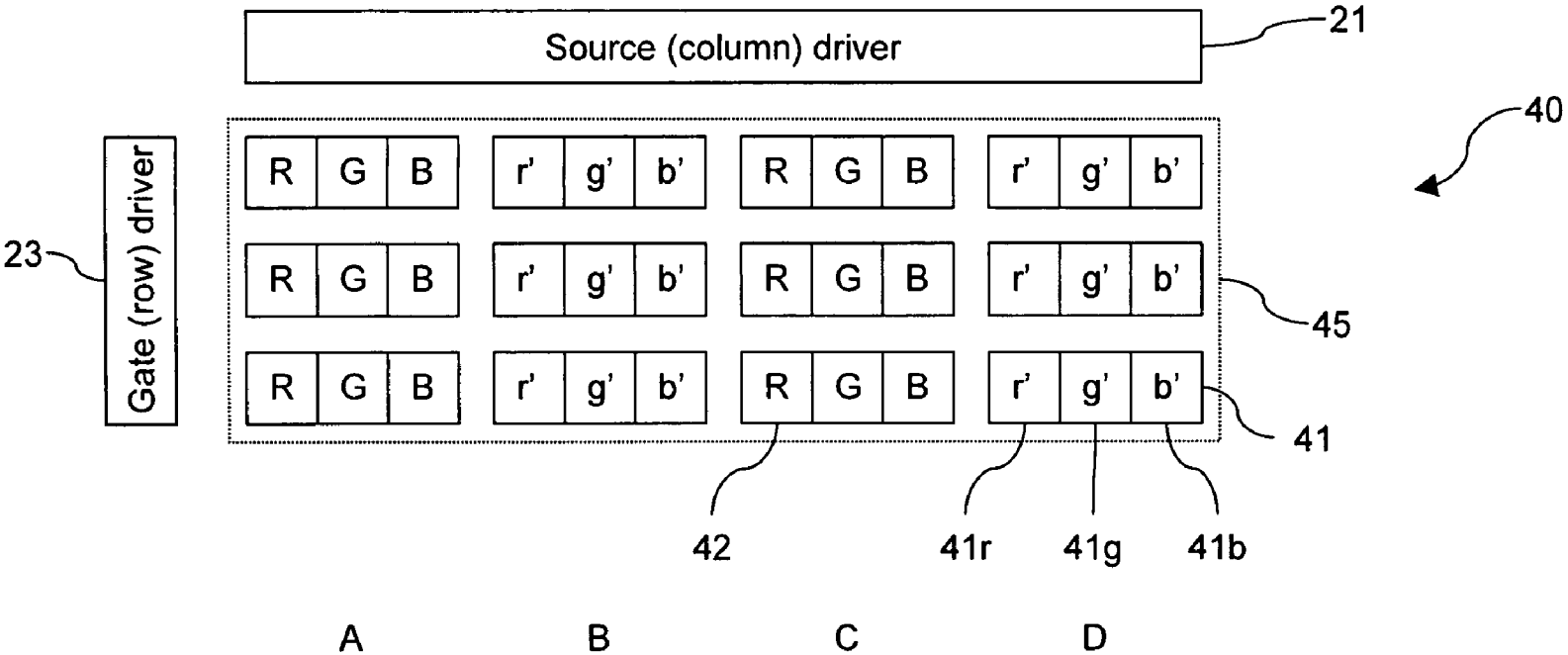
FIG. 4 shows a schematic diagram of a color EL display according to a third embodiment of this invention.

Referring now to FIG. 4, there is shown a color EL display 40 according to a third embodiment of the present invention. EL display 40 includes a source driver 21 and gate driver 23 as in FIG. 2, and a display matrix 45: a two-dimensional array of pixels arranged in rows and columns. Each pixel 41 includes three subpixels arranged in a horizontal stripe: red subpixel 41*r*, green subpixel 41*g*, and blue subpixel 41*b*. The present invention also applies to other pixel color configurations as known in the art, including RGBW pixels or quad patterns; in general, each pixel includes a plurality of subpixels of more than one color. Pixel columns are labeled A through D from left to right. In this case, pixel columns A and C are first columns containing 3T1C subpixels (denoted uppercase R, G, B), e.g. the subpixels in pixel 42. Pixel columns B and D are second columns containing 2T1C subpixels (denoted lowercase r', g', b'), e.g. the subpixels in pixel 41. In such a display, the methods of the first and second embodiment are applied to each color plane independently. That is, the display can be treated as if it were three monochrome displays, one of each color, and compensation applied individually to each. Specifically, when the EL display includes subpixels of more than one color, the adjacent second column can be an adjacent second column of the same color, and the correction signal from a first drive circuit can be used to adjust the drive signals applied to the first drive circuit and one or more adjacent second drive circuits of the same color. "Adjacent" for a color display means "adjacent, discounting intervening columns of different colors" according to common practice in the color image processing art. The same principle can be applied to compensation of e.g. RGBW quad-pattern displays, in which adjacency within a color skips subpixels vertically as well as horizontally.

Figure 5:
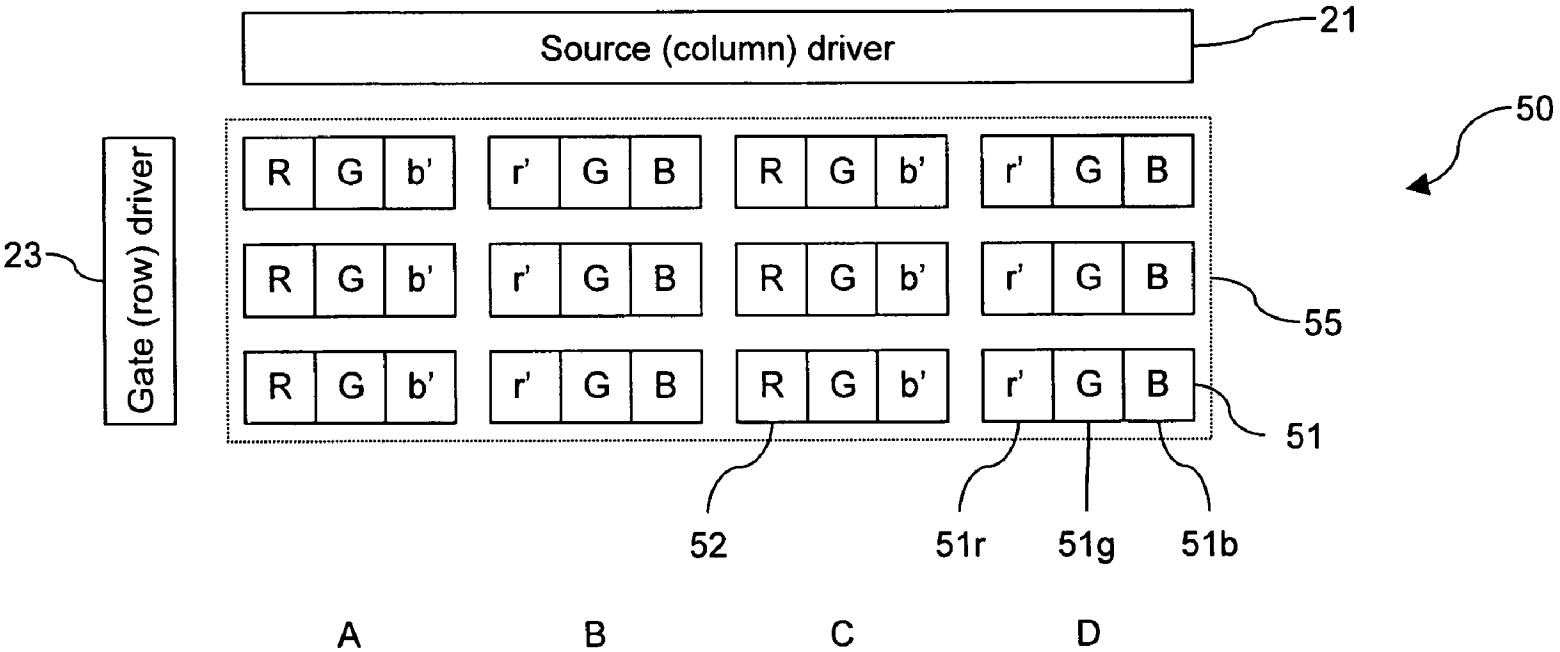
FIG. 5 shows a schematic diagram of a color EL display according to a fourth embodiment of this invention.

Referring now to FIG. 5, in a color display the arrangement of first columns and second columns can be determined based on the colors in those columns. In a fourth embodiment of the present invention, a color EL display 50 includes a source driver 21 and gate driver 23 as in FIG. 4, and a display matrix 55 having pixels 51, 52 including subpixels 51*r*, 51*g*, 51*b*. Display matrix 55 has a different arrangement of first and second columns than display matrix 45. In display matrix 55, every green subpixel column (e.g. 41*g*) is a first column. In addition, in columns A and C, the red subpixel column is a first column, and in columns B and D, the blue subpixel column is a first column. Thus subpixel 51*r* has a second drive circuit and subpixel 51*b* has a first drive circuit. This method only removes one third of the readout lines rather than one half, but even a one-third reduction can reduce cost and improve yield. Further advantages will be discussed below.

Figure 6:
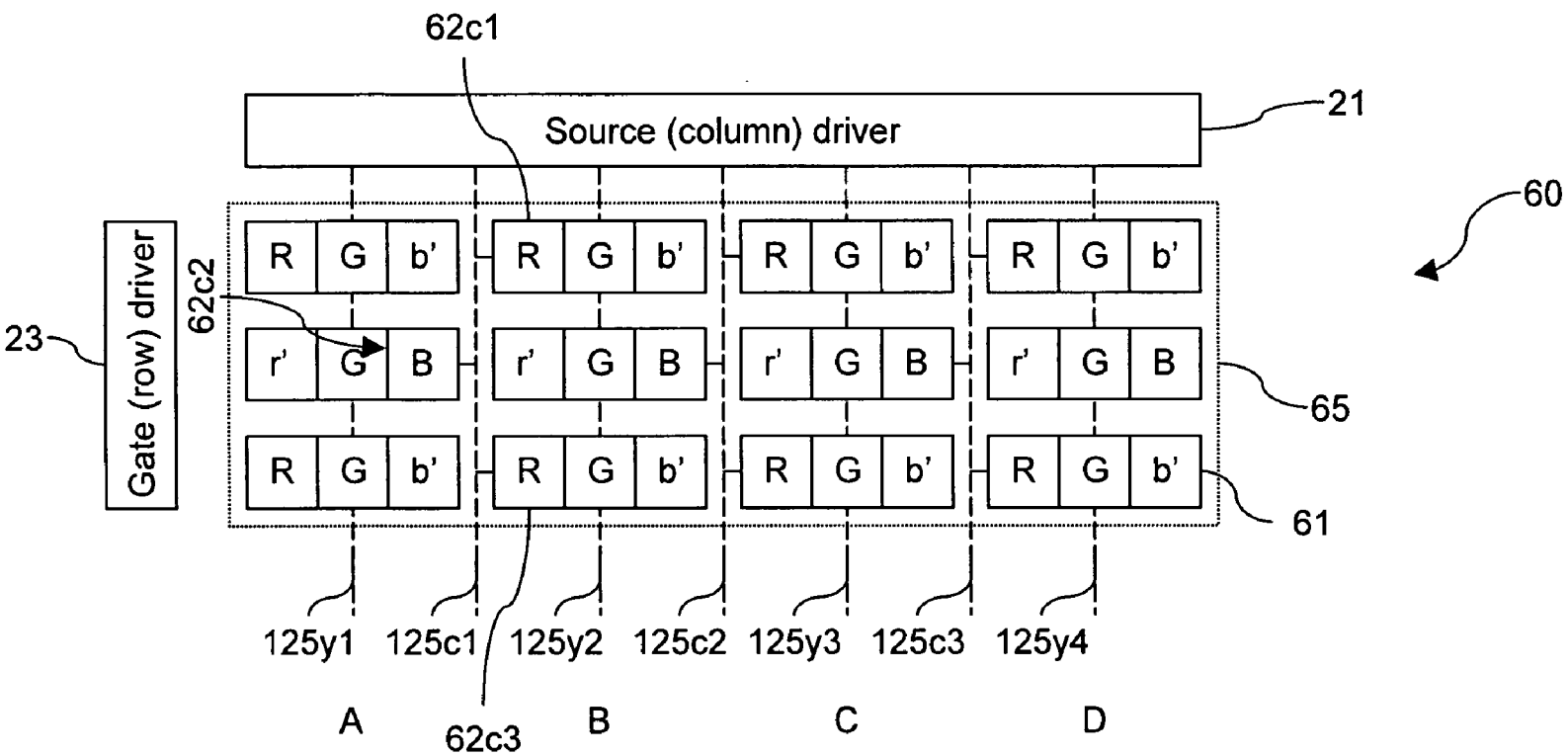
FIG. 6 shows a schematic diagram of a color EL display according to a fifth embodiment of this invention.

Referring now to FIG. 6, in a fifth embodiment of the present invention the red/blue channels are interleaved according to the second embodiment, above. Color display 60 includes a source driver 21 and gate driver 23 as in FIG. 4, and a display matrix 65 having pixels e.g. 61 including red, green, and blue subpixels. In this figure, readout lines 125*y*1, 125*c*1, 125*y*2, 125*c*2, 125*y*3, 125*c*3, and 125*y*4 are shown. All green subpixels are read out on readout lines 125*y*1, 125*y*2, and 125*y*3, the "y" signifying the channel most closely correlated with luminance (Y). Every other red and blue subpixel is read out on readout lines 125*c*1 and 125*c*2, "c" referring to color information. For example, as shown, readout line 125*c*1 is connected to a red subpixel 62*c*1, a blue subpixel 62*c*2, and another red subpixel 62*c*3.

The patterns of the third, fourth and especially fifth embodiments provide high-spatial-frequency information on the aging of the green channel, which is responsible for most of the eye's perception of luminance (brightness), and lower-spatial-frequency information on the aging of the red and blue channels, which are responsible primarily for the eye's perception of chromaticity (color). For example, a well-known color filter pattern (see U.S. Pat. No. 3,971,065) uses this principle. This enables a display with fewer readout lines to maintain very high image quality, as errors in aging compensation are limited to colors where small differences are less visible to the eye.

A color display according to these third, fourth and fifth embodiments can include subpixels of more than one color, and the colors of subpixels in the display can be divided into a first group and a non-overlapping second group, each of which contains at least one color, but less than the total number of colors. All subpixels of colors in the first group can have first drive circuits. At least one subpixel of a color in the second group can have a first drive circuit and at least one can have a second drive circuit. For example, in the third embodiment the first group includes green and the second group includes blue and red.

This approach can be more generally applied to color displays by including more first subpixels in any color plane having a high luminance output (e.g., a color plane peak luminance greater than or equal to 40% of the luminance of a display white point) than in any color channel having a low luminance output (e.g., a color plane peak luminance less than 40% of the luminance of a display white point). The peak luminance of a color plane can be measured by driving all subpixels of that color plane to their maximum output. This can be especially useful in displays having more than three color planes, such as commonly-known RGBW displays that have red, green, blue, and white subpixels. In this case, the white subpixel typically has a high luminance output. In such a display, the green and white subpixels can all be first subpixels. However, the display can additionally have low luminance output red and blue subpixels wherein only half of the red and blue subpixels are first subpixels.

In this case, the EL display can have a selected display white point characterized by luminance (Y) and chromaticity (x, y). The colors of subpixels in the display can be divided into a high-luminance group and a non-overlapping low-luminance group, wherein the high-luminance group includes those colors having a color plane peak luminance greater than or equal to a selected luminance threshold, e.g. 40% of the luminance of the display white point, and wherein the low-luminance group includes those colors having a color plane peak luminance less than the selected luminance threshold, e.g. 40% of the luminance of the display white point. At least one subpixel of a color in the high-luminance group can have a first drive circuit. At least one subpixel of a color in the low-luminance group can have a first drive circuits and at least one have a second drive circuit.

The above embodiments of the present invention provide for reduced cost of an EL display with compensation for burn-in. Image content containing patterns aligned with the divisions between first columns and second columns may possibly cause some visible burn-in in these embodiments. However, such patterns are not commonly found in TV or movie image content, and so there will generally be no difficulty with visible burn-in. A sixth embodiment of the present invention reduces the likelihood of visible burn-in of such pathological patterns.

Referring back to FIG. 3, this sixth embodiment is directed at a method of compensating for changes in the characteristics of transistors and EL devices in a display, includes: providing an EL display 30 having a EL display matrix 35 of EL devices arranged in rows and columns, wherein each EL device is driven by a drive circuit in response to a drive signal to provide an image; providing a first drive circuit 105 for an EL device having three transistors and providing a second drive circuit 305 for an EL device having only two transistors as discussed above, and wherein a first column (e.g. column A) in the display includes at least one first drive circuit and an adjacent second column (e.g. column B) includes at least one second drive circuit; deriving a correction signal based on the characteristics of at least one of the transistors in a first drive circuit, or the EL device, or both; using the correction signal to adjust the drive signals applied to the first drive circuit and one or more adjacent second drive circuits as described above; and changing the location of the image over time. The adjacent second column can also include only second drive circuits. Any of the configurations of first and second columns described above can be employed together with changing the location of the image over time.

For example, in the EL display shown in FIG. 3, and supposing the panel is monochrome so that each pixel includes only one subpixel, the image can initially be positioned so that it originates at subpixel 100*a*, that is, so that its upper-left corner is at subpixel 100*a*. After some time has passed, the image can be moved one pixel to the right so that it originates at subpixel 300*b*. Specifically, the image will be displayed originating at subpixel 100*a* for some time, then there will be a final frame at that position, and the next frame will show the image originating at subpixel 300*b*. Viewers generally cannot see such movement in between frames unless the movement amount is very large. After the image has been moved, at a later time, the image can be moved back to originate at subpixel 100*a*. In this way subpixels 100*a* and 300*b* will be driven with the same average data over time, and so will age approximately the same. Additionally, this movement will average the drive of subpixels e.g. 300*b* and 100*c*, and so forth across the panel and down all rows. This means subpixels e.g. 300*b* and 100*c* will also age approximately the same. This makes averaging and other combinations of compensation signals described above even more effective.

In order to improve the accuracy of averaging, therefore, the movement of the image can be confined to the space covered by an averaging operation. Specifically, given a display including a selected initial first column, one or more selected second columns adjacent to the selected initial first column, and a selected next first column adjacent to one or more of the second columns, the location of the image can be changed over time by less than the distance from the selected initial first column to the selected next first column. Referring to FIG. 3, column A can be the initial first column, column B a second column, and column C a next first column. First columns A and C are two columns apart, so the image can be moved less than two columns. This limit means the image can be moved only one column, leading to repositioning the image one column to the right, then one column to the left, as described above (back and forth between subpixels 100*a* and 300*b*). Multiple second columns can be in between the initial first column and the next first column, allowing more options for moving the image.

In order to further reduce the visibility of burn-in, the image can be moved in two different modes: a short-distance mode that is used more frequently and a long-distance mode that is used less frequently. The short-distance mode can move the image less than the distance from the selected initial first column to the selected next first column, as described above, and the long-distance mode can move the image at least that distance. Continuing the example above, a short distance mode can reposition the image one column to the right, then one column to the left, as described above, while a long-distance mode can reposition the image two columns to the right, then two columns to the left. This can average aging of subpixels on opposite sides of sharp edges in the image content. Referring to FIG. 3, for example, the short-distance mode would move the image back and forth between subpixels 100*a* and 300*b* until the long-distance mode repositioned the image to subpixel 100*c*. At that point the short-distance mode would move the image back and forth between subpixels 100*c* and 300*d* until the long-distance mode moved the image back to subpixel 100*a*.

When the image originates at subpixel 300*b*, the subpixels in column A, which are not showing image content, can be driven with a data signal causing them to display black or the average level of the whole image. Other values can be used for the data signals in column A, for example as taught in U.S. Pat. No. 6,369,851; the present invention does not require any particular value. Additionally, various movement patterns have been taught, for example in U.S. Patent Application Publication No. 2005/0204313 A1. The present invention does not require any particular pattern.

For color displays, the image can be moved as described above, but aligned to the pixel rather than to the subpixel, e.g. image data for a red subpixel can only move to another red subpixel, not to an immediately adjacent green or blue subpixel. Consequently, for displays including subpixels of more than one color, the correction signal from a first drive circuit can be used to adjust the drive signals applied to the first drive circuit and one or more adjacent second drive circuits of the same color. In color displays, subpixels are counted as adjacent for each color independently, as discussed above in the third embodiment.

As discussed above, the prior art teaches various methods for determining when to reposition the image. However, in an EL display, repositioning can be visible while a still image is shown due to the fast subpixel response time of an EL display compared to e.g. an LCD display. Further, changes at predetermined intervals can become visible over time as the human eye is optimized to detect regularity in anything it sees. Finally, in a television application, the display can be active for hours or days at a time, so repositioning the image at display startup can be insufficient to prevent burn-in.

It can be advantageous, therefore, to reposition the image as often as possible without the movement becoming visible to the user. The location of the image can advantageously be changed after a frame of all-black data signals, or more generally after a frame that has a maximum data signal at or below a predetermined threshold. The predetermined threshold can be a data signal representing black. For example, during TV viewing, the image can be repositioned between two of the several black frames between commercials. The data signals for different color planes can have the same thresholds or different thresholds. For example, since the eye is more sensitive to green light than to red or blue, the threshold for green can be lower than the threshold for red or blue. In this case, the location of the image can be changed after a frame that has a maximum data signal in each color plane at or below the selected threshold for that color plane. That is, if a data signal in any color plane is above the selected threshold for that color plane, the location of the image can be left unchanged to avoid visible motion.

Additionally, the location of the image can be changed at least once per hour. The location of the image can be changed during fast motion scenes, which can be identified by image analysis as known in the art (e.g. motion estimation techniques). The times between successive changes of the image location can be different.

The invention has been described in detail with particular reference to certain preferred embodiments thereof, but it will be understood that variations and modifications can be effected within the spirit and scope of the invention. For example, the above embodiments are constructed wherein the transistors in the drive circuits are n-channel transistors. It will be understood by those skilled in the art that embodiments wherein the transistors are p-channel transistors, or some combination of n-channel and p-channel, with appropriate well-known modifications to the circuits, can also be useful in this invention. Additionally, the embodiments described show the OLED in a non-inverted (common-cathode) configuration; this invention also applies to inverted (common-anode) configurations. The above embodiments are further constructed wherein the transistors in the drive circuits are a-Si transistors. The above embodiments can apply to any active matrix backplane that is not stable as a function of time. For instance, transistors formed from organic semiconductor materials and zinc oxide are known to vary as a function of time and therefore this same approach can be applied to these transistors. Furthermore, as 3T1C compensation schemes are capable of compensating for EL device aging independently of transistor aging, the present invention can also be applied to an active-matrix backplane with transistors that do not age, such as LTPS TFTs.

The invention has been described in detail with particular reference to certain preferred embodiments thereof, but it will be understood that variations and modifications can be effected within the spirit and scope of the invention.

PARTS LIST

20 EL display
21 source driver
23 gate driver
25 EL subpixel matrix
30 EL display
35 EL display matrix
40 color EL display
41 color EL pixel
41*b* EL subpixel
41*g* EL subpixel
41*r* EL subpixel
42 color EL pixel
45 color EL display matrix
50 color EL display
51 color EL pixel
51*b* EL subpixel
51*g* EL subpixel
51*r* EL subpixel
52 color EL pixel
55 color EL display matrix
60 color EL display
61 color EL pixels
62*c*1 red subpixel
62*c*2 blue subpixel
62*c*3 red subpixel
65 color EL display matrix
100 EL subpixel
100*a* EL subpixel
100*c* EL subpixel

PARTS LIST CONT'D

105 EL drive circuit
110 first power supply line
110*a* first voltage source
120 data line
120*a* data line
120*b* data line
120*c* data line
120*d* data line
125 readout line
125*a* readout line
125*b* readout line
125*c* readout line
125*c*1 readout line
125*c*2 readout line
125*c*3 readout line
125*d* readout line
125*y*1 readout line
125*y*2 readout line
125*y*3 readout line
125*y*4 readout line
130 select line
130*a* select line
130*b* select line
130*c* select line
145 first electrode
150 second voltage source
155 second electrode
160 EL device
165 gate electrode

PARTS LIST CONT'D

170 drive transistor
180 switch transistor
185 readout transistor
190 capacitor
195 electronics
300 EL subpixel
300*b* EL subpixel
300*d* EL subpixel
305 EL drive circuit

The invention claimed is:

1. A method of compensating for changes in the characteristics of transistors and EL devices in an EL display, comprising:

(a) providing an EL display having a two-dimensional array of EL devices arranged in rows and columns, wherein each EL device is driven by a drive circuit in response to a drive signal;

(b) providing a first drive circuit for an EL device having three transistors and providing a second drive circuit for an EL device having only two transistors, and wherein a first column in the display includes at least one first drive circuit and an adjacent second column includes at least one second drive circuit;

(c) deriving a correction signal based on the characteristics of at least one of the transistors in a first drive circuit, or the EL device, or both; and (d) using the correction signal to adjust the drive signals applied to the first drive circuit and one or more adjacent second drive circuits.

2. The method of claim 1, wherein the adjacent second column includes only second drive circuits.

3. The method of claim 1, wherein the EL devices are OLED devices, and wherein the EL display is an OLED display.

4. The method of claim 1, wherein the transistors are amorphous silicon thin-film transistors.

5. The method of claim 1, wherein the aperture ratio of an EL device driven by a first drive circuit equals the aperture ratio of an EL device driven by a second drive circuit.

6. The method of claim 1, further comprising:

(e) selecting a reference spatial frequency; and (f) arranging first columns on the display with higher spatial frequency than the reference spatial frequency.

7. The method of claim 1, further comprising:

(e) locating one or more sharp transitions in the correction signals over the two-dimensional array; and (f) for each sharp transition, using the correction signal for a first drive circuit to adjust the drive signals applied to the first drive circuit and one or more adjacent second drive circuits on the same side of the sharp transition.

8. The method of claim 7, further comprising:

(g) displaying an image on the EL display;

(h) locating one or more sharp image transitions in the displayed image data; and (i) employing the locations of the sharp transitions and the sharp image transitions to selectively apply correction signals from first drive circuits to adjust the drive signals applied to the first drive circuits and one or more adjacent second drive circuits.

9. The method of claim 1, wherein the EL display comprises subpixels of more than one color, further comprising:

(e) providing a first column in the display and an adjacent second column of the same color; and (f) using the correction signal from a first drive circuit to adjust the drive signals applied to the first drive circuit and one or more adjacent second drive circuits of the same color.

10. The method of claim 9, further comprising:

(g) dividing the colors of subpixels in the display into a first group and a non-overlapping second group, each of which contains at least one color, but less than the total number of colors;

(h) providing first drive circuits to all subpixels of colors in the first group;

(i) providing first drive circuits to at least one of the subpixels of colors in the second group; and (j) providing second drive circuits to at least one of the subpixels of colors in the second group.

11. The method of claim 9, further comprising:

(g) selecting a display white point;

(h) selecting a luminance threshold;

(i) dividing the colors of subpixels in the display into a high-luminance group and a non-overlapping low-luminance group, wherein the high-luminance group comprises those colors having a color plane peak luminance greater than or equal to the selected luminance threshold, and wherein the low-luminance group comprises those colors having a color plane peak luminance less than the selected luminance threshold;

(j) providing first drive circuits to all subpixels of colors in the high-luminance group;

(k) providing first drive circuits to at least one of the subpixels of colors in the second group; and (l) providing second drive circuits to at least one of the subpixels of colors in the second group.

12. A method of compensating for changes in the characteristics of transistors and EL devices in an EL display, comprising:

(a) providing an EL display having a two dimensional array of EL devices arranged in rows and columns, wherein each EL device is driven by a drive circuit in response to a drive signal to provide an image;

(b) providing a first drive circuit for an EL device having three transistors and providing a second drive circuit for an EL device having only two transistors, and wherein a first column in the display includes at least one first drive circuit and an adjacent second column includes at least one second drive circuit;

(c) deriving a correction signal based on the characteristics of at least one of the transistors in a first drive circuit, or the EL device, or both;

(d) using the correction signal to adjust the drive signals applied to the first drive circuit and one or more adjacent second drive circuits; and (e) changing the location of the image over time.

13. The method of claim 12, wherein the adjacent second column includes only second drive circuits.

14. The method of claim 12, further comprising changing the location of the image after a frame that has a maximum data signal at or below a predetermined threshold.

15. The method of claim 14, wherein the predetermined threshold is a data signal representing black.

16. The method of claim 12, wherein the EL display comprises subpixels of more than one color, further comprising:

(f) selecting a threshold level for each color; and (g) changing the location of the image after a frame that has a maximum data signal in each color plane at or below the selected threshold for that color.

17. The method of claim 12, further comprising changing the location of the image at least once per hour.

18. The method of claim 12, further comprising changing the location of the image during fast motion scenes.

19. The method of claim 12, wherein the times between successive changes of the image location are different.

20. The method of claim 12, further comprising:

(f) selecting an initial first column;

(g) selecting one or more second columns adjacent to the selected initial first column;

(h) selecting a next first column, adjacent to one or more of the selected second columns; and (i) changing the location of the image over time by less than the distance from the selected initial first column to the selected next first column.

21. The method of claim 12, further comprising:

(f) selecting an initial first column;

(g) selecting one or more second columns adjacent to the selected initial first column;

(h) selecting a next first column, adjacent to one or more of the selected second columns;

(i) changing the location of the image over time by less than the distance from the selected initial first column to the selected next first column more frequently, and at by least the distance from the selected initial first column to the selected next first column less frequently.

* * * * *